US009938731B1

(12) United States Patent
Wallace et al.

(10) Patent No.: US 9,938,731 B1
(45) Date of Patent: Apr. 10, 2018

(54) INSIDE-OUTSIDE ROLLER FOR STRUCTURAL CORNER BEND

(71) Applicant: Columbia Taping Tools, Ltd., Surrey (CA)

(72) Inventors: Gary Wallace, Surrey (CA); Elliot St. James, Surrey (CA)

(73) Assignee: Columbia Taping Tools, Ltd., Surrey (CA)

( * ) Notice: Subject to any disclaimer, the term of this patent is extended or adjusted under 35 U.S.C. 154(b) by 0 days.

(21) Appl. No.: 15/431,684

(22) Filed: Feb. 13, 2017

Related U.S. Application Data

(60) Provisional application No. 62/293,950, filed on Feb. 11, 2016.

(51) Int. Cl.
*E04F 21/165* (2006.01)
*E04F 21/18* (2006.01)

(52) U.S. Cl.
CPC ..... *E04F 21/18* (2013.01); *E04F 21/1657* (2013.01)

(58) Field of Classification Search
CPC ... E04F 21/026; E04F 21/165; E04F 21/1652; E04F 21/1655; E04F 21/1657; Y10T 156/18; Y10T 156/1795; Y10T 156/1788; B44C 7/06
USPC ..... 156/574, 577, 579; 15/235.7, 235.8; 425/87, 458
See application file for complete search history.

(56) References Cited

U.S. PATENT DOCUMENTS

| | | | | |
|---|---|---|---|---|
| 2,533,209 | A * | 12/1950 | Ames | E04F 21/00 104/119 |
| 4,032,283 | A * | 6/1977 | Johnson | B44D 3/105 118/411 |
| 5,203,954 | A * | 4/1993 | Moore | B44C 7/06 156/574 |
| 6,450,232 | B1 * | 9/2002 | Smythe, Jr. | E04F 21/08 156/574 |
| 6,729,949 | B1 * | 5/2004 | McCoy | B24B 9/00 451/344 |
| D616,907 | S * | 6/2010 | Eirich | D15/199 |
| 2005/0045264 | A1 * | 3/2005 | Kooistra | E04F 21/08 156/71 |
| 2009/0090471 | A1 * | 4/2009 | Rosso | B44C 7/02 156/579 |
| 2011/0265278 | A1 * | 11/2011 | Carpenter | E04F 21/0053 15/235.7 |

* cited by examiner

*Primary Examiner* — Ryan D Kwiecinski
(74) *Attorney, Agent, or Firm* — Schacht Law Office, Inc.; Dwayne Rogge

(57) ABSTRACT

Disclosed is a corner head drywall tool comprising a plurality of roller wings, each with a plurality of face rollers. Also disclosed are alignment rollers intersecting and overlapping the pivot axis of the roller wings. The device may further comprise shafts having an end pivotably attached to each roller wing; wherein each shaft is fitted to slide within a spring tube having a spring therein biasing the shaft toward the associated roller wing. Each spring tube optionally having a median portion pivotably attached to a support block. The device may comprise an adjustment system to adjust the spacing between the ends of the spring tubes opposite the roller wings. The drywall tool may be arranged wherein the adjustment comprises: an adjustment wheel fixed to rotate relative to the support block. Wherein the adjustment wheel rotates one or each spring tube about the relative pivot attachment to the support block.

5 Claims, 8 Drawing Sheets

INSIDE-OUTSIDE ROLLER FOR STRUCTURAL CORNER BEND

This application claims priority benefit of U.S. Ser. No. 62/293,950, filed Feb. 11, 2016, incorporated herein by reference.

BACKGROUND OF THE DISCLOSURE

Field of the Disclosure

This disclosure relates to the field of taping tools in drywall taping and mudding functions involving a corner between two wall surfaces.

Brief Summary of the Disclosure

Disclosed herein is a corner head drywall tool comprising: a first roller wing; a plurality of face rollers attached to the first roller wing at a first horizontal pivot axis; a plurality of first alignment rollers having a horizontal roller axis intersecting and overlapping the first horizontal pivot axis; a second roller wing pivotably attached to the first roller wing at a vertical pivot intersecting the first horizontal pivot axis; a plurality of face rollers attached to the second roller wing at a second horizontal pivot axis intersecting the vertical pivot axis; and a plurality of second alignment rollers having a horizontal roller axis intersecting and overlapping the second horizontal pivot axis.

The corner head drywall tool as disclosed above may further comprise: a first shaft having a first end pivotably attached to the first roller wing; wherein the first shaft is fitted to slide within a first spring tube having a spring therein biasing the first shaft toward the first roller wing. The first spring tube optionally having a median portion pivotably attached to a support block; a second shaft having a first end pivotably attached to the second roller wing; the second shaft fitted to slide within a second spring tube having a spring therein biasing the second shaft toward the second roller wing; and the spring tube having a median portion pivotably attached to the support block.

The corner head drywall tool as recited above may further comprise an adjustment system configured to adjust the spacing between the ends of the first spring tube and second spring tube opposite the roller wings.

The corner head drywall tool as recited above may be arranged wherein the adjustment system comprises: an adjustment wheel fixed to rotate relative to the support block; and the adjustment wheel rotating the first spring tube and or second spring tube about the relative pivot attachment to the support block.

DETAILED DESCRIPTION OF THE DISCLOSURE

Figure 18:
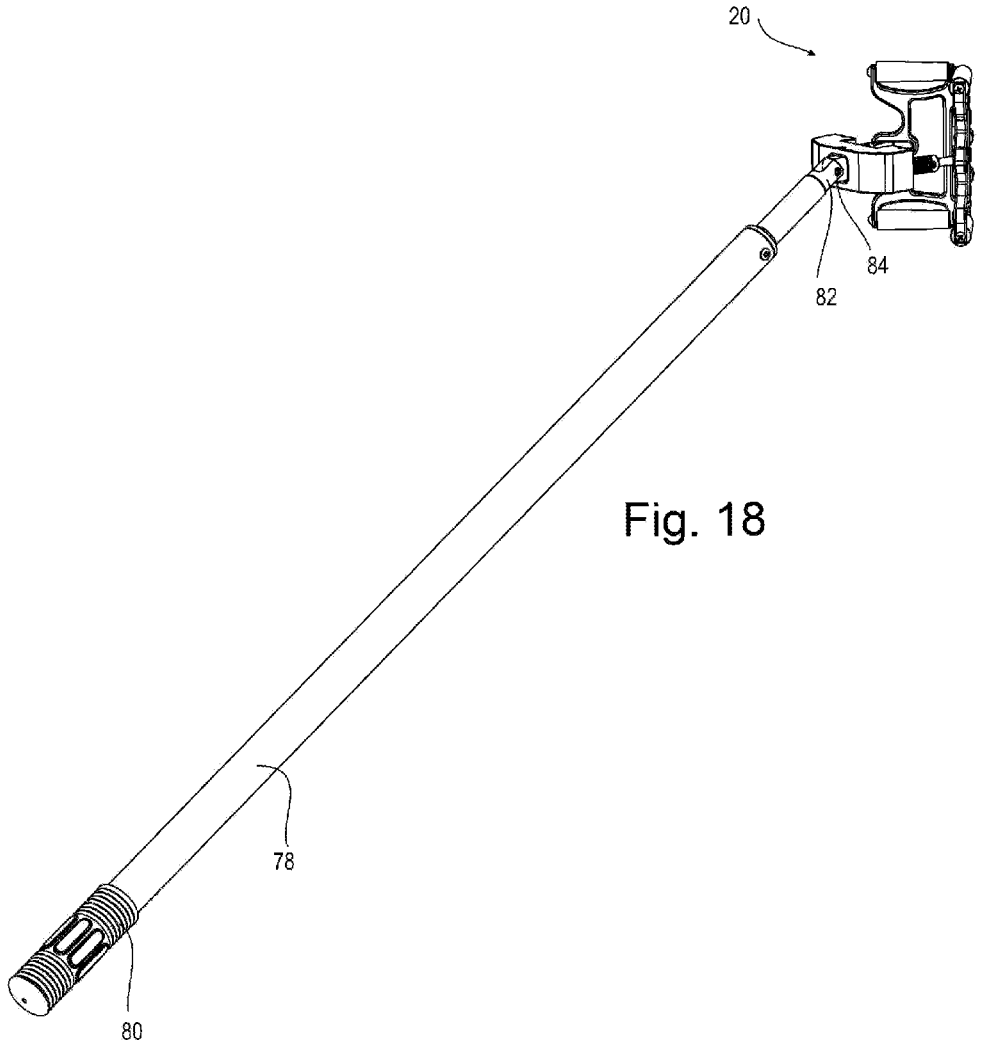
FIG. 18 shows one example of the Corner Head for Mast Tube attached to one example of a mast tube.

Disclosed herein is a drywall tool including a corner head which may in one example be configured to be attached to a mast tube as shown in FIG. 18. The corner head is particularly well suited for application of semi rigid structural laminates such as are attached to inside and outside corners where two wall surfaces join. Such semi-rigid structural laminates often have a flexible and often creased median portion configured to join two laterally outward portions by bending inward or outward to conform to the corner. One particular example is the no-Coat® ultra Flex™ 450 or 325 structural laminate.

Figure 1:
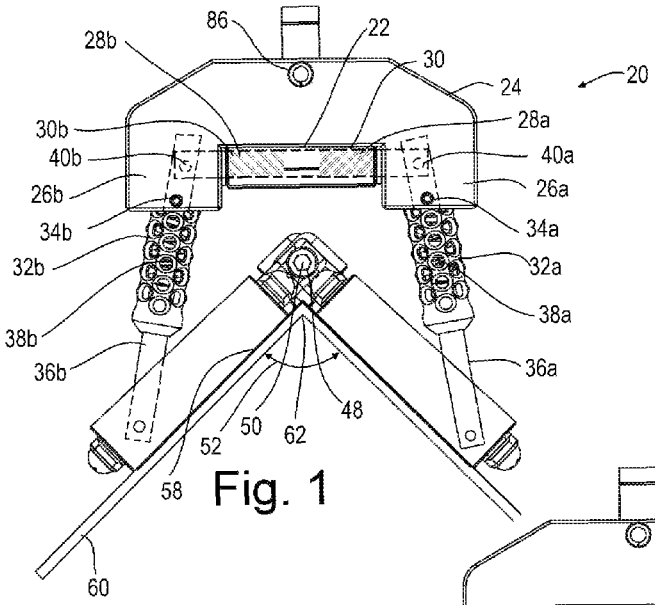
FIG. 1 is a top view of one example of the Corner Head for Mast Tube apparatus used on a first outside corner in a drywall (plasterboard, wallboard, gypsum board) application between two wall sections where the angle between the wall sections is substantially between 180° and 270°.

The inside-outside roller for structural corner bend (corner head) 20 in the example of FIG. 1 and others consists of a central adjusting wheel 22 rotatably attached to a rigid support block 24. The support block 24 of this example has a plurality of extensions 26*a* and 26*b* between which extends the adjustment wheel 22. The interior of this adjustment wheel 22 having on one end right-hand threads 28*a*, and on the opposing end, left-hand threads 28*b*. Thus moving attached components in opposing longitudinal directions as the central adjusting wheel 22 is rotated. Male threaded shafts 30*a* and 30*b* having coordinating threads are threaded into the central adjusting wheel from opposing end and thus engage the adjustment wheel roll 22. These shafts 30 are therefore longitudinally repositioned in opposing directions as the adjustment will 22 is rotated.

To allow for wall imperfections, user error, and adjustment imperfections, a plurality of perforated spring tubes 32 (*a* and *b*) are attached by way of pivots 34 (*a* and *b*) respectively to the support block 24. The perforated spring tubes 32 each have a shaft 36 passing there through with a compression or tension spring 38 (*a* and *b*) biasing each shaft 36 (*a* and *b*) away from the support block 24. One end of each of the perforated spring tubes 32 is attached by way of a pivot 40 (*a* and *b*) to an associated shaft 28. Thus, as the adjustment wheel 22 is rotated the distal ends of the shafts 36 are moved further from each other, or closer to each other, dependent upon the direction of rotation of the adjustment wheel 22.

The spring tubes 32 may have a large number of large perforations through the surface thereof to the spring 38 and shaft 36 to allow drywall mud which enters the interior space to be washed out or when dried permitted to crumble and pass out as fine particles.

It is also conceived that the spring tubes 32 are not perforated, and formed to reduce the entry of drywall mud and other contaminates as much as possible to the interior space thereof.

Figure 2:
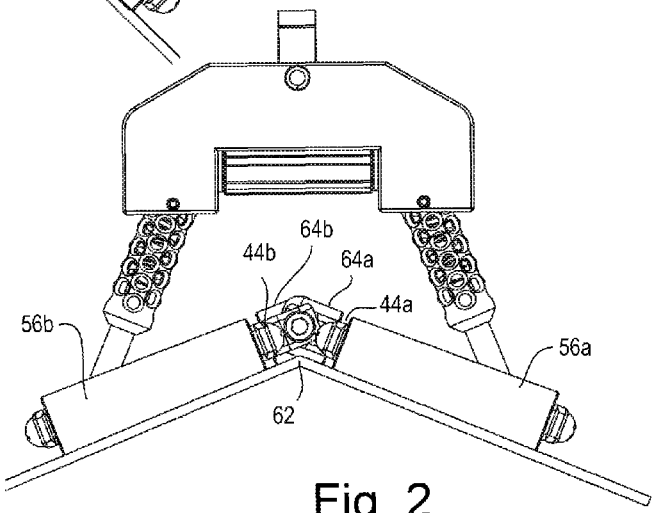
FIG. 2 is a top view of the apparatus of FIG. 1 used on a second outside corner.
Figure 3:
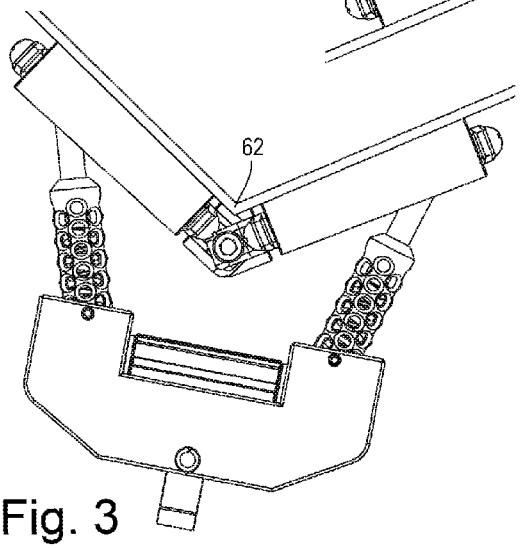
FIG. 3 is top view of the apparatus of FIG. 1 used on a third outside corner.
Figure 7:
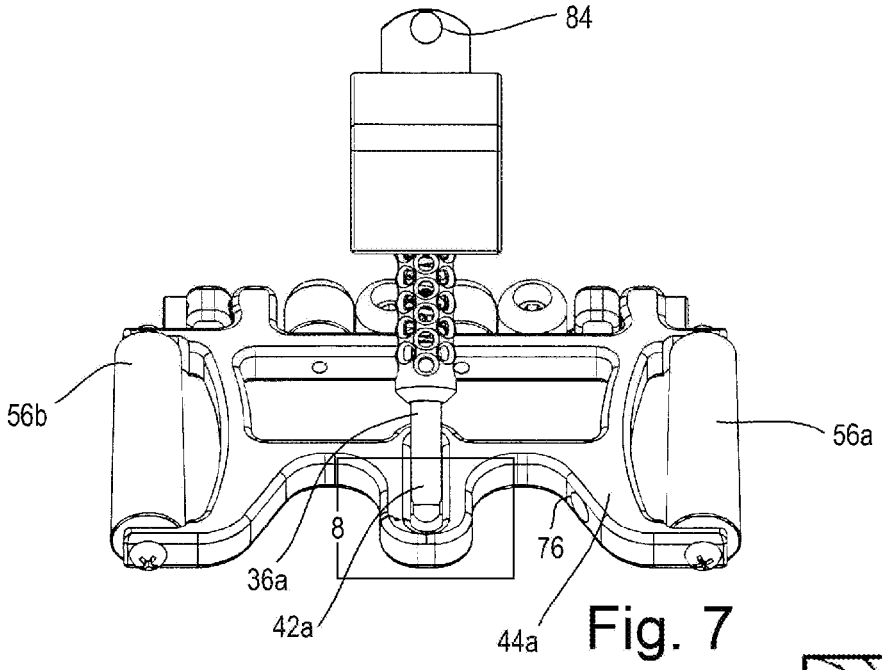
FIG. 7 is a side view of the one example of the Corner Head for Mast Tube arranged as shown in FIG. 1.
Figure 8:
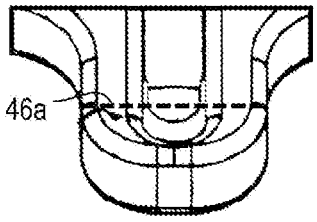
FIG. 8 is a detail view of the region 8 of FIG. 7.
Figure 9:
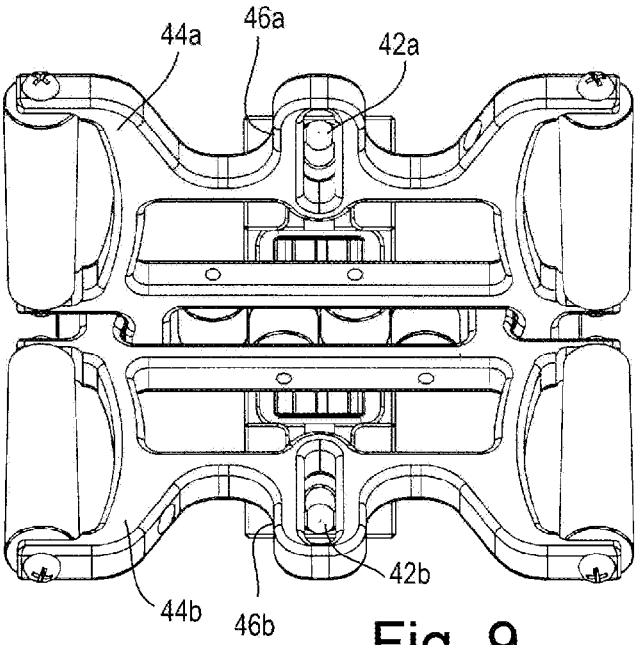
FIG. 9 is a front view of one example of the Corner Head for Mast Tube arranged as shown in FIG. 1.

Looking to FIG. 7 it can be seen that in this example, the distal end 42 (*a* and *b*) of each shaft 36 is attached to a substantially rigid roller wing 44 (*a* and *b*) by way of a pivot pin 46 (*a* and *b*). The roller wings 44*a* and 44*b* in this example are connected by way of a pivot 48 which is more easily seen in FIG. 1. The pivot 48 has in this example a vertical pivot axis 50 about which the roller wings pivot to fit corners of different angles. In this configuration, as the adjustment wheel 22 is rotated, and the distance between the distal ends 42 (*a* and *b*) of the shafts 36 changes, the angle 52 between the roller wings 44 adjusts to fit corners of different angles. In one example, as the distal ends 42 are repositioned to their widest spacing such that the roller wings 44 are substantially lying in the same plane, the apparatus may be repositioned by pushing or pulling on the pivot 48 for outside angles (180° to 360°) as shown in FIG. 1-3 or inside angles (0° to 180°) as shown in FIG. 4-6.

Figure 11:
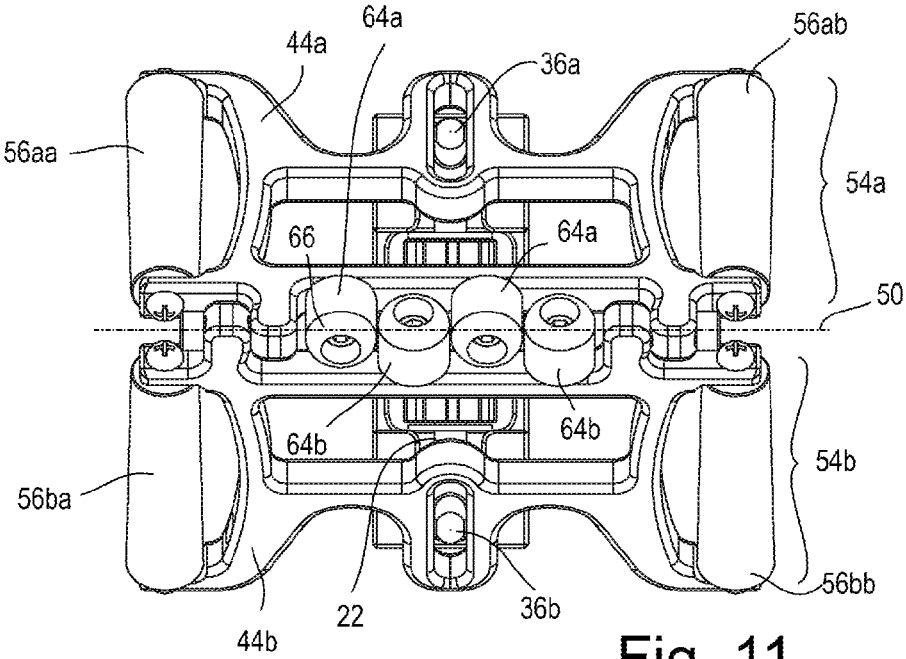
FIG. 11 is a front view of the apparatus shown in FIG. 10.
Figure 12:
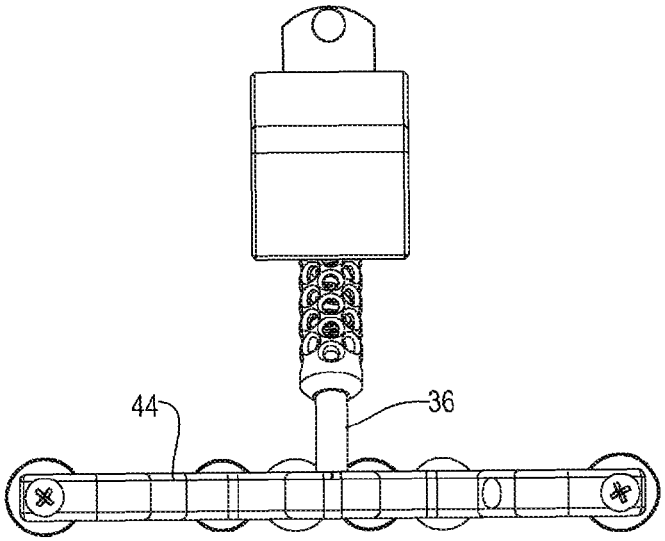
FIG. 12 is a side view of one example of the corner head in a configuration where the faces of both roller wings lie in the same plane.
Figure 13:
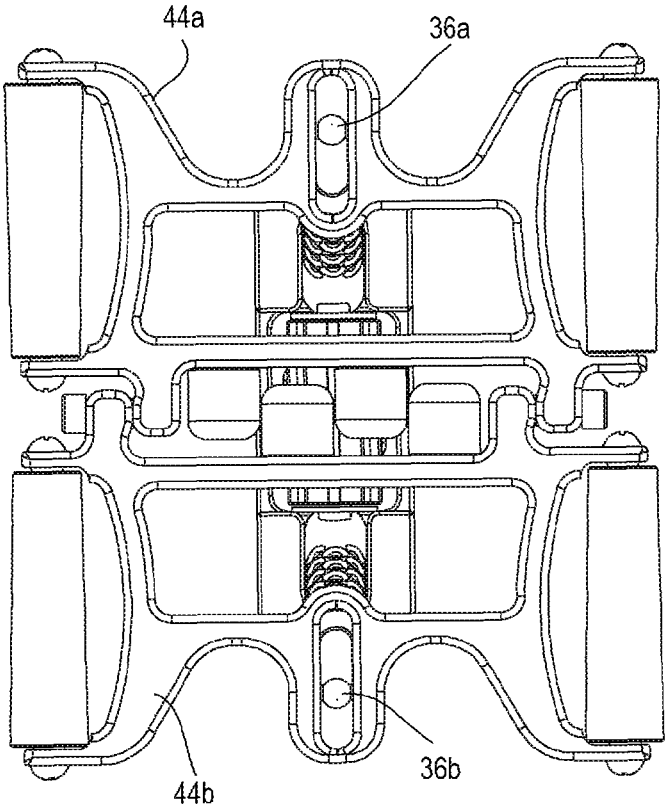
FIG. 13 is a front view of the apparatus of FIG. 12.

Looking to FIG. 11 Each of the roller wings 44 have a set (pair) 54 (*a* and *b*) of face rollers 56 attached to a roller wing 44. The face rollers 56 protrude radially outward from the drywall facing surface of each roller wing 44. In this example, the face rollers 54 are substantially equally as wide (long) as the roller wing 44. In use, these face rollers 56 press the structural laminate 58 against the drywall 60 on either side of the corner 62 as shown in FIG. 1-FIG. 6.

Returning to the example shown in FIG. 11, it can be seen that in addition to the face rollers 56 (*a, b, aa, ba*), a series of alignment rollers 64*a* are attached to each roller wing 44. These alignment rollers 64 each have a rotation axis which intersects and is orthogonal to the pivot axis 50 connecting the roller wings 44. Thus, as can be seen in FIG. 1-FIG. 6, these alignment rollers 64 engage both sides of the corner 62 to align the corner head 20 during use. The alignment rollers 64 overlap the apex of the corner 62 thus correctly aligning the fold or bend in the laminate 58 upon the apex of the corner 62. Generally, the laminate 58 is attached to the drywall with drywall mud or a similar adhesive which may be allowed to flow under the laminate until the adhesive hardens or cures. Thus the alignment rollers 64 correctly align the laminate relative to the corner 62 and the face rollers 56 press the wings of the laminate 58 against the drywall 60 on either side of the corner 62.

Figures 4, 5, 6:
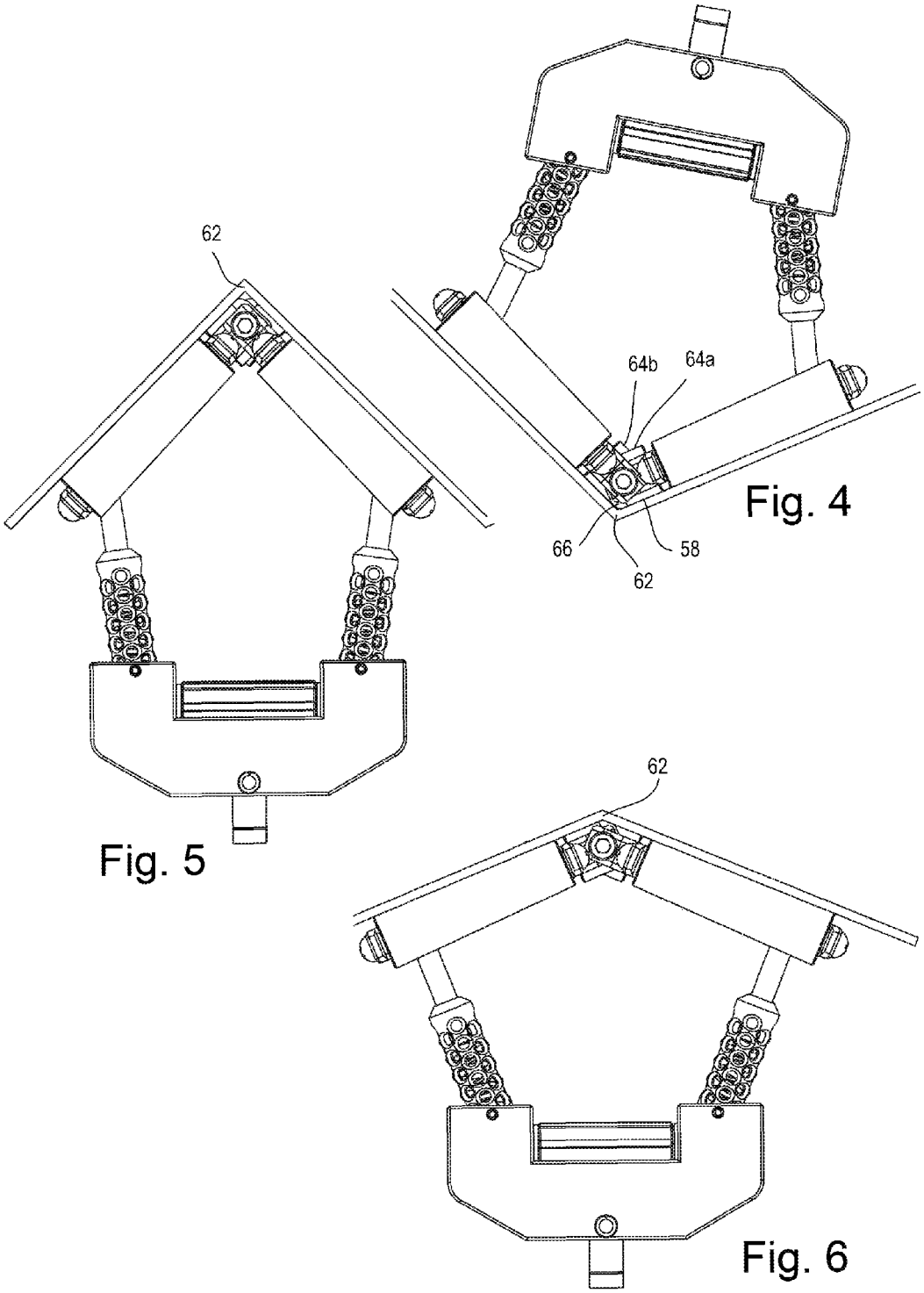
FIG. 4 is a top view of the apparatus of FIG. 1 used on a first inside corner where the angle between the wall sections is substantially between 45° and 180°.
FIG. 5 is a top view of the apparatus of FIG. 1 used on a second inside corner.
FIG. 6 is a top view of the apparatus of FIG. 1 used on a third inside corner.

Looking to the example of FIG. 4 it can be seen that the alignment rollers 64*a* overlap the alignment rollers 64*b* of the opposing roller wing 44 inward of the corner 62. However; as each of the alignment rollers 64 of this example has a radiused distal end 66, the laminate 58 is still correctly aligned relative to the corner 62 without binding, as might happen in an example where the distal ends 66 of the alignment rollers 64 are not radiused.

Figure 14:
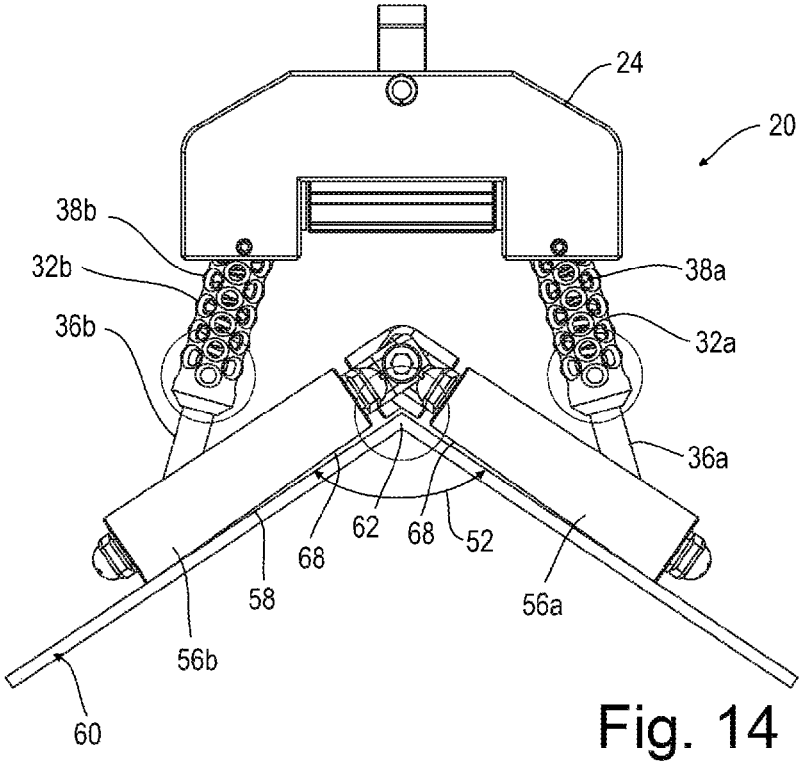
FIG. 14 is a top view of the apparatus shown in FIG. 3 improperly adjusted to the corner.

The corner head 20 allows for some misalignment of the corner head 20 or variance of the angle 52. Looking to FIG. 14 it can be seen that the angle between the face rollers 56*a* and 56*b* is not set perfectly to conform to the outside angle 52 of the corner 62. Thus, a gap 68 is formed between one end of the face rollers 56 and the laminate 58. In a rigid construction of prior known corner heads 20, this misalignment would result in a poor application of the laminate 58 after installation. However: in this example; as some movement of the shafts 36 is permitted by way of the springs 38 within the spring tubes 32, the corner head 20 of this example is permitted to self-adjust. This self-adjustment overcomes minor alignment errors and accounts for variations in the angle 52, surface imperfections in the wall, drywall, laminate, or varying thicknesses of adhesive used between the laminate 58 and the drywall 60, as well as varying thicknesses of drywall mud or similar compositions used between the laminate 58 and the face rollers 56.

Figure 15:
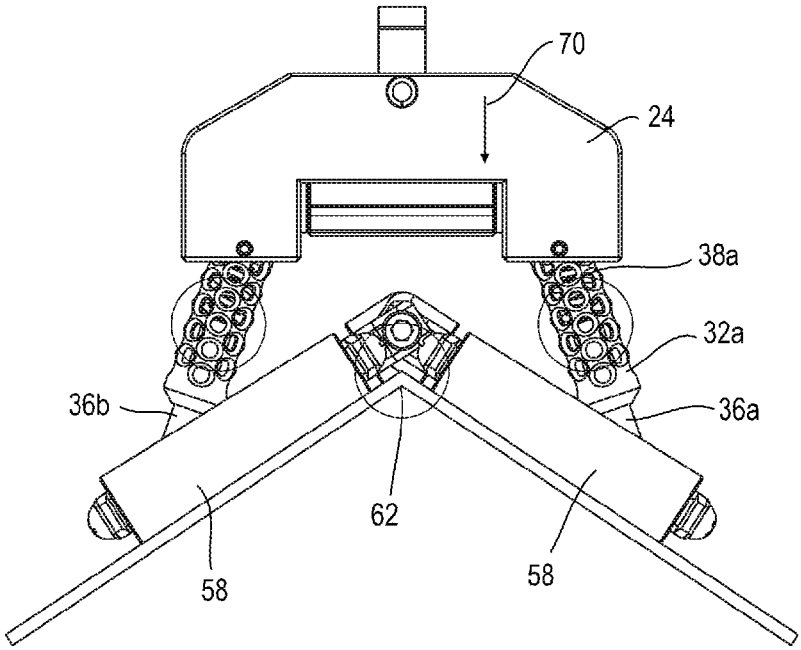
FIG. 15 shows the apparatus of FIG. 14 compensating for the mal-adjustment.

Looking to FIG. 15, it can be seen that the shafts 36 have compressed some distance into the spring tubes 32 as the support block 24 is pressed in direction 70 toward the corner 62. This force has compressed the springs 38 and altered the angle between the face rollers 58 to conform to the angle between the drywall surfaces at the corner 62.

Figure 16:
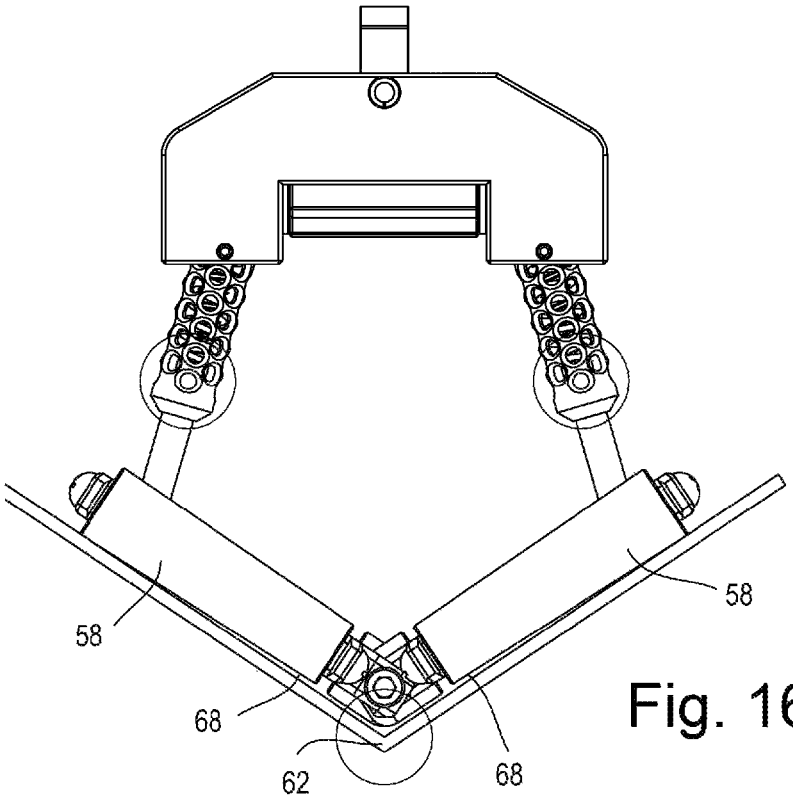
FIG. 16 is a top view of the apparatus shown in FIG. 4 improperly adjusted to the corner.
Figure 17:
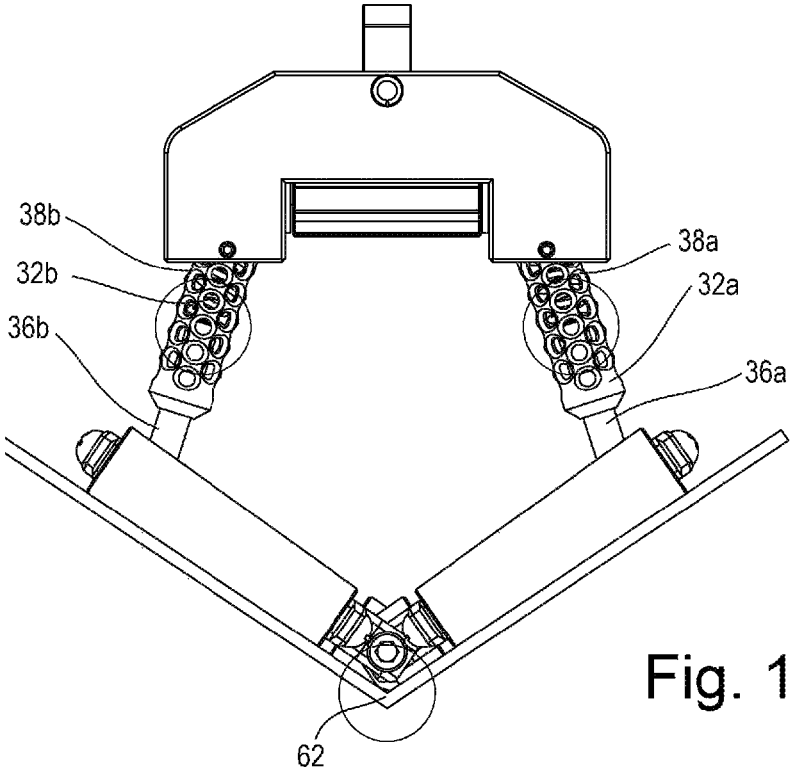
FIG. 17 shows the apparatus of FIG. 16 compensating for the mal-adjustment.

Similarly, FIG. 16 shows an example wherein the face rollers 58 are not properly adjusted to the inside corner 62, and a gap 68 has thus formed between the face rollers 56 and the laminate 58 on either side of the apex of the corner 62. Looking to FIG. 17, once again the shafts 36 have compressed the springs 38 and the apparatus overcomes the misalignment as it is pressed in direction 70 toward the corner 62.

Figure 10:
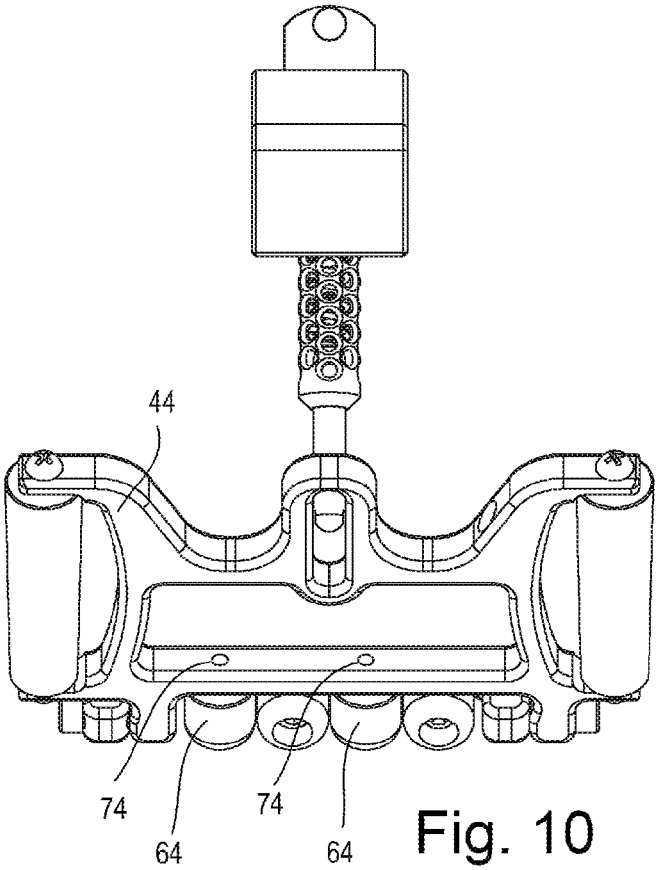
FIG. 10 is a side view of one example of the Corner Head for Mast Tube arranged as shown in FIG. 5.

In FIG. 10, the inward ends of the axles 74 of alignment rollers 64 can be seen where they are attached to the roller wing 44.

Looking to FIG. 7, a void forming a pivot access 76 is shown allowing access for insertion or removal of the pivot pin 46 after the face roller 56*a* is removed.

Looking to FIG. 18 is shown a long handle or mast tube 78 having a user grasping portion 80 on a first end, and a corner head attachment 82 at the opposing end. As is known in the art, a user may grasp along any portion of the mast tube 78 outward of the attachment 82. In this example, the corner head attachment 82 comprises a universal joint having a horizontal pivot axis 84 and a vertical pivot axis 86. The mast tube 78 thus allows for longer strokes of the corner head 20 than when the corner head 20 is held in hand. This allows the operator to easily acess hard-to-reach areas such as wall-to-ceiling corners, ceiling-to-ceiling corners, and wall corners that reach beyond the normal reach of the operator.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A corner head drywall tool comprising:

a first roller wing;

a plurality of first face rollers attached to the first roller wing, each of the plurality of first face rollers having parallel pivot axes;

a plurality of first alignment rollers attached to the first roller wing, each of the plurality of first alignment rollers having a roller axis parallel to the pivot axis of each of the plurality of first face rollers;

a second roller wing pivotably attached to the first roller wing at a roller wing pivot intersecting the pivot axis of each of the plurality of first face rollers;

wherein the second roller wing is configured to rotate about the roller wing pivot to change the angle between the first roller wing and the second roller wing;

the axes of the plurality of first alignment rollers overlap and intersect the roller wing pivot;

a plurality of second face rollers attached to the second roller wing, each of the plurality of second face rollers having parallel pivot axes a plurality of second alignment rollers attached to the second roller wing, each of the plurality of second alignment rollers having a roller axis parallel to each of the pivot axes of the plurality of the first face rollers when the first roller wing and the second roller wing lie in the same plane; and the axes of the plurality of second alignment rollers overlap and intersect the roller wing pivot.

2. The corner head drywall tool as recited in claim 1 wherein each of the plurality of first and second alignment rollers has a radiused distal end.

3. A corner head drywall tool comprising:

a first roller wing;

a plurality of first face rollers attached to the first roller wing, each of the plurality of first face roller having a pivot axis parallel to the pivot axis of each of the other first face rollers of the plurality of first face rollers;

a plurality of first alignment rollers having a roller axis parallel to the pivot axis of each of the plurality of first face rollers;

a second roller wing pivotably attached to the first roller wing at a roller wing pivot intersecting the pivot axis of each of the plurality of first face rollers;

the axes of the plurality of first alignment rollers overlapping and intersecting the roller wing pivot;

a plurality of second face rollers attached to the second roller wing, each of the plurality of second face rollers having a pivot axis parallel to the pivot axis of the other second face rollers;

a plurality of second alignment rollers having a roller axis parallel to the pivot axis of each of the plurality of first face rollers;

the axes of the plurality of second alignment rollers overlapping and intersecting the roller wing pivot;

a first shaft having a first end pivotably attached to the first roller wing;

the first shaft fitted to slide within a first spring tube having a spring therein biasing the first shaft toward the first roller wing;

the first spring tube having a median portion pivotably attached to a support block;

a second shaft having a first end pivotably attached to the second roller wing;

the second shaft fitted to slide within a second spring tube having a spring therein biasing the second shaft toward the second roller wing; and the second spring tube having a median portion pivotably attached to the support block.

4. The corner head drywall tool as recited in claim 2 further comprising an adjustment system configured to adjust the spacing between a first end of the first spring tube and a first end of the second spring tube opposite the first and second roller wings.

5. The corner head drywall tool as recited in claim 4 wherein the adjustment system comprises:

an adjustment wheel fixed to rotate relative to the support block; and the adjustment wheel rotating at least one of the first spring tube or the second spring tube about the relative pivot attachment to the support block.

* * * * *